US010224156B2

(12) United States Patent
Han et al.

(10) Patent No.: US 10,224,156 B2
(45) Date of Patent: Mar. 5, 2019

(54) DE-BOUNCING KEYPAD AND PREPARATION METHOD THEREOF

(71) Applicant: NANTONG MEMTECH TECHNOLOGIES CO., LTD., Nantong, Jiangsu (CN)

(72) Inventors: Huisheng Han, Jiangsu (CN); Zhenxing Wang, Jiangsu (CN); Yang Ding, Jiangsu (CN); Hongmei Zhang, Jiangsu (CN); Zhihao Dong, Jiangsu (CN); Jie Shi, Jiangsu (CN)

(73) Assignee: Nantong Memtech Technologies Co., Ltd., Nantong Jiangsu (CN)

( * ) Notice: Subject to any disclaimer, the term of this patent is extended or adjusted under 35 U.S.C. 154(b) by 24 days.

(21) Appl. No.: 15/318,074

(22) PCT Filed: Jul. 15, 2015

(86) PCT No.: PCT/CN2015/084167
§ 371 (c)(1),
(2) Date: Dec. 12, 2016

(87) PCT Pub. No.: WO2016/011911
PCT Pub. Date: Jan. 28, 2016

(65) Prior Publication Data

US 2017/0133174 A1 May 11, 2017

(30) Foreign Application Priority Data

Jul. 21, 2014 (CN) ..... 2014 1 0347066

(51) Int. Cl.
*H01H 13/10* (2006.01)
*H01H 1/021* (2006.01)
(Continued)

(52) U.S. Cl.
CPC ..... *H01H 13/10* (2013.01); *C23C 18/1689* (2013.01); *C23C 18/1692* (2013.01);
(Continued)

(58) Field of Classification Search
CPC ..... H01H 13/785; H01H 13/702; H01H 2201/03; H01H 13/703; H01H 2201/024;
(Continued)

(56) References Cited

U.S. PATENT DOCUMENTS 4,366,355 A 12/1982 Oelsch
2010/0258631 A1* 10/2010 Rueblinger ..... G06K 7/10881 235/462.48

(Continued)

FOREIGN PATENT DOCUMENTS

| | | |
|---|---|---|
| CN | 1091548 | 8/1994 |
| CN | 103700517 | 4/2014 |
| CN | 104112616 | 10/2014 |

OTHER PUBLICATIONS

International Search Report filed in PCT/CN2015/084167 dated Oct. 19, 2015.

*Primary Examiner* — Ahmed M Saeed
(74) *Attorney, Agent, or Firm* — Rankin, Hill & Clark LLP

(57) ABSTRACT

The present invention discloses a de-bouncing keypad and a preparation method thereof, wherein the keypad is composed of a rubber substrate and a metal contact having three layers of layered structures. A layer of tin alloy or lead alloy is plated on a surface of the metal contact by electroplating or chemical plating. The metal contact plated with the tin alloy or lead alloy has excellent contact bouncing resistance and arc-ablation resistance, and the metal contact is further composited with the rubber to shape and prepare the rubber de-bouncing keypad.

21 Claims, 3 Drawing Sheets

(51) Int. Cl.

| | |
|---|---|
| ***C25D 3/56*** | (2006.01) |
| ***C25D 3/60*** | (2006.01) |
| ***C25D 5/02*** | (2006.01) |
| ***H01H 1/025*** | (2006.01) |
| ***H01H 11/06*** | (2006.01) |
| ***C25D 5/34*** | (2006.01) |
| ***C25D 5/36*** | (2006.01) |
| ***C25D 5/40*** | (2006.01) |
| ***C25D 7/00*** | (2006.01) |
| ***C23C 18/16*** | (2006.01) |
| ***C23C 18/32*** | (2006.01) |
| ***C23C 18/52*** | (2006.01) |
| ***H01H 13/785*** | (2006.01) |

(52) U.S. Cl.

CPC ..... *C23C 18/32* (2013.01); *C23C 18/52* (2013.01); *C25D 3/56* (2013.01); *C25D 3/60* (2013.01); *C25D 5/02* (2013.01); *C25D 5/34* (2013.01); *C25D 5/36* (2013.01); *C25D 5/40* (2013.01); *C25D 7/00* (2013.01); *H01H 1/021* (2013.01); *H01H 1/025* (2013.01); *H01H 11/06* (2013.01); *H01H 13/785* (2013.01); *H01H 2011/065* (2013.01); *H01H 2201/002* (2013.01); *H01H 2201/022* (2013.01); *H01H 2229/014* (2013.01)

(58) Field of Classification Search

CPC ..... H01H 2201/026; H01H 2201/032; H01H 2205/002; H01H 2209/002; H01H 2227/002; H01H 2227/018; H01H 2203/02; H01H 2207/008

USPC ..... 345/173; 200/314, 317, 345, 512, 514, 200/61.04, 267–269

See application file for complete search history.

(56) References Cited

U.S. PATENT DOCUMENTS

2010/0289762 A1* 11/2010 Ito ..... B32B 7/02 345/173

2010/0307898 A1* 12/2010 Liu ..... H01H 13/83 200/314

2013/0335371 A1* 12/2013 Bayramoglu ..... G06F 3/041 345/174

* cited by examiner

DE-BOUNCING KEYPAD AND PREPARATION METHOD THEREOF

TECHNICAL FIELD

The present invention particularly relates to a spare part between two conductors in a switch or a circuit of an electric or electronic product allowing a current to pass through mutual contact (i.e., an electric contact or contact) and a preparation method thereof.

BACKGROUND

When a mechanical switch containing a metal contact is switched on or off, the contact may not be steadily switched on or off at once due to the elastic effect of the contact, but a series of bouncing (i.e., a series of switching on and off) occurs at the moment of switching on or off. The bouncing time may be more than 20 ms. Contact bouncing (or keypad bouncing, switch bouncing) may cause that one manual switching operation will be read by mistake for multiple times. This bouncing will cause a "double hit" response of a circuit in a less serious case, and will cause complete failure of circuit design in a severe case to cause various accidents. Therefore, the contact bouncing has to be eliminated in some applications. Method for eliminating the contact bouncing include a hardware method, a software method and other methods. The hardware method is to add a de-bouncing circuit, while the software method includes a delay method and a sampling method. These methods are introduced in the following literatures.

[1]. Li Hongyu, Huang Hesong and Ji Peifeng. Three Reliable Methods for Preventing Mechanical Bouncing [J], Electronic Component Application, 2004, 6(6), 53-55.

[1]. Zeng Yi, Xi Dashun and Li Xiangyang, Keypad Switch Bouncing and De-bouncing Method [J], Electronics World, 2005, (9), 55-56.

[2]. Fang Long, Xiao Xianbao and Li Wei. Study about Removing Keypad Mechanical Bouncing [J], Guangxi Journal of Light Industry, 2008, (1), 92, 105.

Patent document with an application No. 201110340157.5 "Keypad de-bouncing method, apparatus and keypad" and patent document with an application No. 200910058845.5 "Keypad de-bouncing method and system" disclose keypad de-bouncing through keypad information processing method and system. Both patent document with an application No. 201310004739.5 "Anti-bouncing circuit" and patent document with an application No. 201210555174.5 "Switch circuit capable of eliminating mechanical bouncing" de-bounce through an anti-bouncing circuit. Patent document with an application No. 200780034448.3 "Switch circuit and related de-bouncing method" conducts de-bouncing treatment on the output quantity of a switch through a sigma-delta modulator. American patent 7809867 "Keypad de-bouncing apparatus and method" and American patent application 20110004711 "Keypad de-bouncing apparatus and method" also eliminate keypad bouncing through circuit design. No matter the hardware method or the software method eliminates the influences of contact and keypad bouncing through circuit, circuit hardware or circuit software. According to the present invention, the contact bouncing will be fundamentally weakened or eliminated by plating a layer of tin alloy or lead alloy on a metal material of the contact, and the arc-ablation resistance or service life of the contact will be improved in the meanwhile.

The invention with an application patent number 201110193369.5 of the inventor provides a "Pitted-surface metal and rubber composite conductive particle" which is formed by adhering a metal surface layer to a rubber matrix or slitting after adhesion. The metal surface layer is a pitted surface and has concave pits or convex points or both the two; the concave pits or convex points are formed on an outer surface, or an inner surface of the metal surface layer, or both the outer surface and the inner surface; the depths of the concave pits are smaller than the thickness of the metal surface layer; and the heights of the convex points are no less than one tenth of the thickness of the metal surface layer. The metal surface layer is made of metal or alloy; gold, silver, copper, aluminum, nickel, chromium, rhodium, zinc, molybdenum, tin, cobalt, tungsten or ferrum and alloy thereof can be coated on the outer surface of the metal surface layer; the rubber matrix is made of silicone rubber or urethane rubber; an adhesion layer can be arranged between the metal surface layer and the rubber matrix; the adhesion layer is made of a heat vulcanization adhesive, a prime coat or a material identical to the rubber matrix. Aids such as a coupling agent can be coated on the inner surface of the metal surface layer. The metal surface layer of the invention has high strength and stable conductivity of electricity, the adhesion layer has high strength, and the rubber matrix has sufficient elasticity. However, the invention does not provide solutions for solving the bouncing problem and arc-ablation problem of the conductive particle. The invention does not provide a specific method about how to obtain one or more plated layers on the outer surface of the metal surface layer either, and does not explain how to selectively deposit a metal plated layer on the metal surface without depositing rubber.

SUMMARY

The present invention disclose a de-bouncing keypad which is composed of a rubber substrate and a metal contact, wherein the metal contact is a layered complex having three layers of layered structures and typically in a shape of cylinder or elliptic cylinder; as shown in FIG. 1, a first layer of the metal contact is a rubber layer having a thickness of 0.1-10 mm, a second layer is a sheet metal layer having a thickness of 0.1-10 mm and containing magnesium, aluminum, titanium, chromium, manganese, ferrum, cobalt, nickel, copper, zinc, niobium, molybdenum, silver, tin, tantalum or tungsten, and a third layer is a tin alloy plated layer or lead alloy plated layer having a thickness of 0.1-10 μm; wherein, the third layer is formed by any one of the three methods below:

a first method is to dip a complex of the first layer and the second layer in an electroplating bath containing a soluble tin compound or lead compound, and selectively deposit a tin alloy or lead alloy on a metal surface of the complex by electroplating to form the third layer;

a second method is to dip the complex of the first layer and the second layer in a chemical plating bath containing the soluble tin compound or lead compound, and selectively deposit the tin alloy or lead alloy on the metal surface of the complex by chemical deposition to form the third layer; and a third method is to plate the tin alloy or lead alloy on one side or two sides of a metal substrate of the second layer by chemical plating or electroplating, and then composite the metal substrate with the rubber to form the layered complex having three layers of structures including the rubber layer, the sheet metal layer and the plated layer.

The metal contact marked in FIG. 1 can be obtained through the three methods.

The rubber substrate in the de-bouncing keypad is prepared by natural rubber, styrene butadiene rubber, butadiene rubber, ethylene propylene rubber, ethylene propylene diene monomer, urethane rubber, methylvinylsiloxane gum or polymethylvinylphenylsiloxane gum; and the rubber substrate is preferably prepared by ethylene propylene diene monomer, methyl vinyl silicone rubber o polymethylvinylphenylsiloxane gum. The material of the rubber substrate is preferably identical to the material of the hydrophobic rubber layer in the metal contact, so that an excellent adhesive strength is obtained during the heat vulcanization adhesion of the two.

In the first method and the second method for preparing the third layer (tin alloy plated layer or lead alloy plated layer) of the metal contact above, the first layer is formed by hydrophobic rubber; the hydrophobic rubber is a rubber material enabling a water contact angle on a rubber surface to be greater than 65 degrees since contents of carboxyl, hydroxyl radical, carbonyl, amino group, acylamino, nitrile group, nitro, halogeno, sulfhydryl group, sulfonate and benzene sulfonate are low, or a rubber material enabling the water contact angle on the rubber surface to be greater than 65 degrees since the rubber contains no or contains a small amount of hydrophobic filler or additive.

The hydrophobic rubber has water repellency, and water cannot be spread on the surface of the hydrophobic rubber. To implement selective electroplating or chemical plating, the hydrophoby of the rubber material in the complex of the hydrophobic rubber layer in the first layer and the sheet metal in the second layer is, the better. To make the metal deposited on the hydrophobic rubber layer in the first layer to an amount that can be ignored, the water contact angle of the rubber substrate needs to be greater than 65 degrees. The carboxyl, hydroxyl radical, carbonyl, amino group, acylamino, nitrile group, nitro, halogeno, sulfhydryl group, sulfonate and benzene sulfonate on the rubber molecular chain will greatly increase the polarity and hydrophily of the rubber. Particularly, the carboxyl, hydroxyl radical, sulfonate and benzene sulfonate will greatly increase the polarity and hydrophily of the rubber. Therefore, the contents of these groups in the rubber have to be controlled. Polar rubber like nitrile rubber and hydrogenated nitrile rubber with a high nitrile group content, carboxy-terminated butadiene nitrile liquid rubber, chlorosulfonated polyethylene rubber, epichloro-hydrin rubber, acrylic rubber, urethane rubber, and hydrophilic rubber (like hydrophilic silicone rubber), water swelling rubber, and materials like a rubber material containing a number of hydrophilic or water-absorbent fillers, a rubber material containing surfactant or anti-static agent have big polarity, or big polarity on the surfaces of the materials, and are not suitable to be used in the switch contact of the present invention. If such rubber materials are used, the metal will be deposited on these rubber materials more or less during electroplating or chemical plating. If a metallic deposit layer is formed on the rubber material, not only the plating bath is wasted, but also the heat vulcanization adhesion or thermoplastic adhesion of the rubber material with other rubber material is unfavorable, while the heat vulcanization adhesion is required in subsequent processing.

As an optimization, the hydrophobic rubber layer is prepared by nonpolar or weak polar rubber. As a further optimization, the hydrophobic rubber layer is prepared by ethylene propylene diene monomer, methylvinylsiloxane gum or polymethylvinylphenylsiloxane gum. The ethylene propylene diene monomer, methylvinylsiloxane gum and polymethylvinylphenylsiloxane gum are nonpolar rubber, which have strong hydrophoby and good weather resisting property at the same time, and can keep excellent elasticity for a long term in atmosphere; therefore, the ethylene propylene diene monomer, methylvinylsiloxane gum and polymethylvinylphenylsiloxane gum are materials preferably selected for the hydrophobic rubber layer.

In the third method for preparing the third layer (tin alloy plated layer or lead alloy plated layer) of the metal contact above, the hydrophoby of the rubber in the first layer is not required strictly. Rubber having weak hydrophoby can also be used for preparing the rubber layer in the metal contact.

The sheet metal layer in the present invention is a metal sheet having a convex point or a concave point, a metal sheet having a convex line or a concave line, a metal sheet having a convex surface or a concave surface, a metal sheet having a small hole with an area less than 1 $mm^2$, a metal gauze, metal foams or a metal fiber sintered felt; the metal is magnesium, aluminum, titanium, chromium, manganese, ferrum, cobalt, nickel, copper, zinc, niobium, molybdenum, silver, tin, tantalum or tungsten, or an alloy containing the elements; and the sheet metal is a single metal or composited by different metals in a layered manner. Metal or alloy with better chemical stability, higher electric conductivity and lower price is preferably selected as the material of the sheet metal layer.

As an optimization, the sheet metal of the sheet metal layer is composed of a stainless steel sheet, a copper or copper alloy sheet, and a nickel or nickel alloy sheet having a thickness of 0.01-1.0 mm, and a pure nickel layer or a nickel alloy layer, a pure cobalt layer or a cobalt alloy layer having a thickness of 0.1-10 μm is plated on one side or two sides of the stainless steel sheet, the copper or copper alloy sheet and the nickel or nickel alloy sheet; and the pure nickel layer or the nickel alloy layer, the pure cobalt layer or the cobalt alloy layer on the stainless steel sheet, the copper or copper alloy sheet, and the nickel or nickel alloy sheet is prepared by vacuum plating, electroplating or chemical plating.

As an optimization, the sheet metal of the second layer is composed of a stainless steel sheet, a copper or copper alloy sheet, and a nickel or nickel alloy sheet having a thickness of 0.01-1.0 mm, and a pure nickel layer or a nickel alloy layer having a thickness of 0.1-10 μm is plated on one side or two sides of the stainless steel sheet, the copper or copper alloy sheet and the nickel or nickel alloy sheet; and the nickel alloy layer on the stainless steel sheet, the copper or copper alloy sheet, and the nickel or nickel alloy sheet is prepared by vacuum plating, electroplating or chemical plating. Plating one pure nickel layer or nickel alloy layer, cobalt or cobalt alloy, and molybdenum or molybdenum alloy on the stainless steel, the copper or copper alloy sheet, and the nickel or nickel alloy sheet may improve the adhesive strength between the sheet metal and the plated layer, and avoid the plated layer from falling out during the use process of the contact.

The thickness of the sheet metal should not be too thin. If the thickness of the sheet metal of the second layer is lower than 0.01 mm, the plated layer cannot be supported preferably, and is easy to break before, during or after the processing of being composited with the rubber. If the sheet metal of the second layer is too thick, the entire hardness of the contact will be increased, which makes separating or punching processing to be difficult, and also wastes the metallic materials. Therefore, the thickness of the sheet metal should be no more than 1.0 mm.

To prepare the hydrophobic rubber layer in the first layer and the sheet metal in the second layer into a layered complex in advance is to facilitate using the layered complex as a contact to prepare a rubber keypad. Heat vulcanization adhesion or thermoplastic adhesion can be directly conducted between the hydrophobic rubber on the layered complex and other rubber to form a rubber keypad. If the rubber keypad is formed without performing heat vulcanization adhesion or thermoplastic adhesion between the sheet metal of the rubber layer and other rubber, an excessive rubber phenomenon will occur during moulding. The so-called excessive rubber phenomenon means that the rubber overflows to the front side of the contact during moulding, thus affecting the electrical conductivity of the contact. The excessive rubber phenomenon on the contact is unacceptable from the aspect of the quality of the contact.

A preparation method of a de-bouncing keypad disclosed by the present invention includes the following steps of:

(1) treatment of sheet metal: the sheet metal being a stainless steel sheet, a copper or copper alloy sheet and a nickel or nickel alloy sheet having a thickness of 0.01-1.0 mm; using a cleaning agent and an organic solvent to deoil and clean the sheet metal; or mechanically roughing a surface of the sheet metal through sand blasting and polishing; or processing the sheet metal through chemical etching into concave pits or convex points having a diameter less than 1 mm; or plating a pure nickel layer or a nickel alloy layer, and a cobalt or cobalt alloy layer having a thickness of 0.1-10 μm on one side or two side of the sheet metal by electroplating or chemical plating; then using the cleaning agent and the organic solvent to deoil and clean the sheet metal obtained;

(2) adhesion treatment of hydrophobic rubber and sheet metal: adhering a hydrophobic rubber layer onto the sheet metal coated with a prime coat or an adhesion promoter through heat vulcanization adhesion and heat vulcanization shaping, to form a layered composite sheet; or adhering the hydrophobic rubber with self-adhesiveness on a sheet metal coated with a prime coat or not coated with a prime coat through heat vulcanization adhesion and heat vulcanization shaping, to form a layered composite sheet;

(3) cutting treatment: separating or punching the composite sheet in the step above into a cylinder comprising a hydrophobic rubber layer and a sheet metal layer and having a diameter of 2-10 mm; or separating or punching the composite sheet in the step above into an object having a cross section in a shape of ellipse, polygon, crisscross, star or crescent or any combinations thereof; using a basic cleaning liquid to wash the object for about 5 min, washing the object by water, then using 5% hydrochloric acid to clean the object for about 1 min, using deionized water to clean the object cleanly, and then draining off the object;

(4) preparation of coated layer: dipping the cylinder or the object above in a chemical plating bath containing a soluble tin compound or lead compound and stirring to form a plated layer on a metal surface of the cylinder or the object by chemical plating; or, putting the cylinder above into a roller for a chemical plating bath containing a soluble tin compound or lead compound to make the roller rotate and form a plated layer on the metal surface of the cylinder or the object by chemical plating;

the chemical plating bath containing 2.5-100 g/L soluble tin compound and/or lead compound, 5-100 g/L complexing agent, 10-125 g/L reducing agent and 0-50 g/L pH regulator;

the soluble tin compound being stannous chloride, stannous mono-sulphate, stannic chloride, sodium stannate, tin fluoborate, stannous acetate and stannous oxalate, wherein the stannous acetate and the stannous oxalate are insoluble to water, and are resolved by diluted hydrochloric acid before using;

the soluble lead compound being lead chloride, lead nitrate, and lead acetate;

the complexing agent being sodium citrate, sodium potassium, sodium salt of ethylene diamine tetraacetic acid (EDTA), and nitrilotriacetic acid;

the reducing agent being titanium trichloride and sodium hypophosphite;

the pH regulator being potassium hydroxide, sodium hydroxide, aqueous ammonia, inorganic acid (such as hydrochloric acid) or organic acid (such as lactic acid and benzene sulfonic acid), strong-acid weak-base salt (such as ammonium sulfate) or strong-base weak-acid salt (such as sodium acetate and sodium carbonate);

the temperature of the chemical plating being controlled within 50-95° C. to ensure a certain reaction velocity;

the time of the chemical plating being controlled between 10 min and 2 h to ensure the thickness of the plated layer, wherein the thickness of the plated layer is more than 0.3 μm usually, which can remarkably reduce the bouncing time of the contact, and even avoid the bouncing of the contact;

(5) cleaning and drying: taking out the plated object above, using distilled water or deionized water to rinse the object, then draining the object off, and using cold air to blow-dry, or putting the object into a 70° C. constant temperature oven to dry, thus obtaining a switch contact with a metal surface layer coated with a tin alloy or lead alloy;

(6) after-plating treatment: applying the contact obtained in the step above to step (7) or applying the object before or after step (7), and performing after-plating treatment on the contact coated with the tin alloy or lead alloy, wherein a method for after-plating treatment includes:

applying a layer of water-soluble or an organic solvent tin alloy protective agent or a tin plated layer surface inhibitor on a surface of the tin alloy or lead alloy of the contact, or following the method described in the invention patent application No. 03119045.6 "Tin plated layer surface inhibitor and using process thereof"; or coating a layer of a complex of non-conductive lubricating oil, lithium-based grease or silicone having arc extinction and lubrication effects on the surface of the tin alloy or lead alloy of the sheet, wherein commercialized arc extinction grease is preferably selected; or using a leady alkaline solution to treat the sheet plated with the tin alloy to replace partial tin on the surface of the sheet with lead, to form a tin lead alloy on the surface of the contact; and (7) performing heat vulcanization adhesion and heat vulcanization shaping on the metal contact above and the rubber, wherein the rubber layer in the metal contact above is combined with other rubber in the metal contact while shaping, and prepared into a de-bouncing rubber keypad;

or, changing the step above into preparing the plated layer firstly, then performing adhesion treatment on the sheet metal having the plated layer with the hydrophobic rubber layer, to prepare a composite sheet having the plated layer.

Another preparation method of a de-bouncing keypad disclosed by the present invention includes the following steps of:

(1) treatment of sheet metal layer: the sheet metal layer being a stainless steel sheet, a copper or copper alloy sheet, and a nickel or nickel alloy sheet having a thickness of 0.01-1.0 mm; either roughing one side or two sides of the stainless steel, copper or copper alloy, nickel or nickel alloy sheet through mechanical polishing, sand blasting and chemical etching, or coating a pure nickel layer or a nickel alloy layer, a pure cobalt layer or a cobalt alloy layer, a molybdenum layer or a molybdenum alloy layer having a thickness of 0.05-10 μm through a vacuum plating, electroplating or chemical plating method, or only cleaning the sheet;

(2) adhesion treatment of hydrophobic rubber layer and sheet metal layer: adhering a hydrophobic rubber layer onto the sheet metal layer coated with a prime coat or an adhesion promoter through heat vulcanization adhesion and heat vulcanization shaping, to form a composite sheet; or adhering the hydrophobic rubber with self-adhesiveness on a sheet metal layer coated with a prime coat or not coated with a prime coat through heat vulcanization adhesion and heat vulcanization shaping, to form a composite sheet;

(3) preparation of coated layer: dipping the composite sheet above in an electroplating bath containing a soluble tin or lead compound to form a tin alloy or lead alloy plated layer on a metal surface of the composite sheet by electroplating;

the plating bath containing 5-100 g/L soluble tin compound or lead compound, 5-100 g/L complexing agent, 5-100 g/L reducing agent and 2-50 g/L pH regulator;

(4) after-plating treatment: applying the sheet obtained in the step above to step (5) or applying the object before or after step (5), and performing after-plating treatment on the sheet coated with the tin alloy or lead alloy, wherein a method for after-plating treatment comprises:

applying a layer of water-soluble or an organic solvent tin alloy protective agent or a tin plated layer surface inhibitor on a surface of the tin alloy or lead alloy of the sheet, or following the method described in the invention patent application No. 03119045.6 "Tin plated layer surface inhibitor and using process thereof"; or coating a layer of a complex of non-conductive lubricating oil, lithium-based grease or silicone having arc extinction and lubrication effects on the surface of the tin alloy or lead alloy of the sheet, wherein commercialized arc extinction grease is preferably selected; or using a leady alkaline solution to treat the sheet plated with the tin alloy to replace partial tin on the surface of the sheet with lead, to form a tin lead alloy on the surface of the sheet;

(5) cutting treatment: separating or punching the composite sheet in the step above into a cylinder including a rubber layer, a sheet metal layer and a plated layer and having a diameter of 2-10 mm; and (6) taking the cylinder above as a metal contact to perform heat vulcanization adhesion and heat vulcanization shaping with the rubber, wherein the rubber layer in the metal contact above is combined with other rubber in the rubber layer while shaping, and prepared into a de-bouncing rubber keypad;

or, changing the step above into preparing the plated layer firstly, then performing adhesion treatment on the sheet metal having the plated layer with the hydrophobic rubber layer, to prepare a composite sheet having the plated layer.

The electroplating bath or chemical plating bath for preparing the tin alloy plated layer or lead alloy plated layer may contain a soluble tin compound and a soluble lead compound at the same time; as an optimization, the plating bath for preparing the tin alloy plated layer or the lead alloy plated layer contains 5-100 g/L stannous chloride and lead chloride, wherein a weight ratio of the stannous chloride to the lead chloride is 5:1-100:1. The plated layer obtained in this way has more tin and less lead. The existence of less lead will inhibit the "whisker crystallization" (or called "whisker") of the tin alloy plated layer during storage and use.

The electroplating plating bath or chemical plating bath above contains 0.05-2 g/L brightener; and the brightener is formaldehyde, acetaldehyde, β-naphthol, 2-methyl aniline-aldehyde condensates, benzalacetone, cuminaldehyde, benzophenone, chlorobenzaldehyde, peregal, schiff base, butynediol, propiolic alcohol, 1-diethylaminoprop-2-yne, propynol ethoxylate, benzoic sulfimide (also called saccharin), sodium benzosulfimide (also called sodium saccharin), sodium vinylsulfonate, sodium proparagylsulfonate, pyridine-2-hydroxypropanesulfonate inner salt, alkylphenol polyoxyethylene or commercially available commercialized chemical plating brightener. A "bright tin" plated layer will be obtained after adding the brightener such as sodium saccharin in the chemical plating bath of the tin alloy. A bright plated layer will be obtained while using the brightener in electroplating a tin and lead alloy plated layer, but the components of the plated layer (i.e., a proportion of tin and lead) will also be changed. Therefore, a proportion of stannous ions and lead ions in the plating bath need to be changed accordingly when using the brightener, so that the tin lead alloy plated layer with the components required can be obtained.

Advantageous Effects the metal contact in the keypad of the present invention has a layer of tin alloy, lead alloy or tin-lead alloy, so as to have excellent contact bouncing resistance; moreover, the arc-ablation resistance of the metal contact having the tin alloy, lead alloy or tin-lead alloy is also better than that of a metal contact prepared by metal materials without a plated layer like stainless steel, copper and copper alloy, nickel and nickel alloy, cobalt and cobalt alloy, or the like, so that the operating reliability of the contact can be improved. Or, the present invention eliminates contact bouncing and prolongs the service life of the contact through coating a tin or lead alloy plated layer on the metal contact. Because the contact contains the rubber layer, the contact is suitable for heat vulcanization adhesion and heat vulcanization shaping with other rubber, thus preparing a rubber keypad product having a contact. One de-bouncing keypad switch is formed by combining the key and a printed circuit board (PCB) together.

DETAILED DESCRIPTION

Embodiment 1

Figure 1:
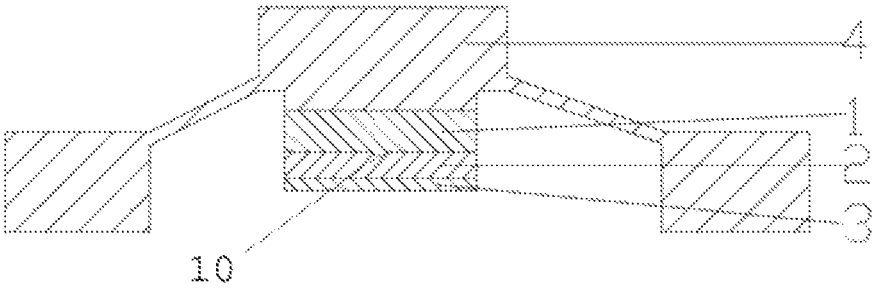
FIG. 1 is a structural schematic diagram of a de-bouncing keypad according to the present invention; in the figure: 1 refers to rubber layer; 2 refers to sheet metal layer; 3 refers to tin alloy or lead alloy plated layer; 4 refers to rubber substrate; and a metal contact is composed of 1, 2 and 3.
Figure 2:
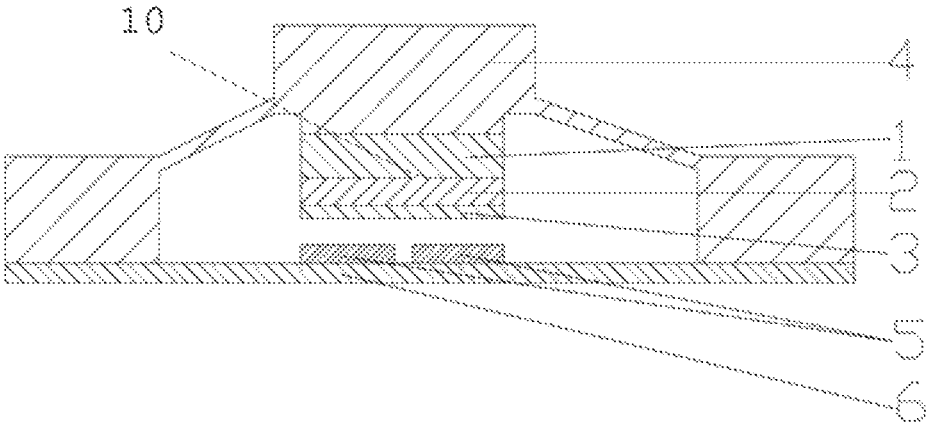
FIG. 2 is a schematic diagram of a de-bouncing keypad switch; in the figure: 1 refers to rubber layer; 2 refers to sheet metal layer; 3 refers to tin alloy or lead alloy plated layer; 4 refers to rubber substrate; 5 refers to gold-plated contact on printed circuit board; and 6 refers to printed circuit board.
Figure 3:
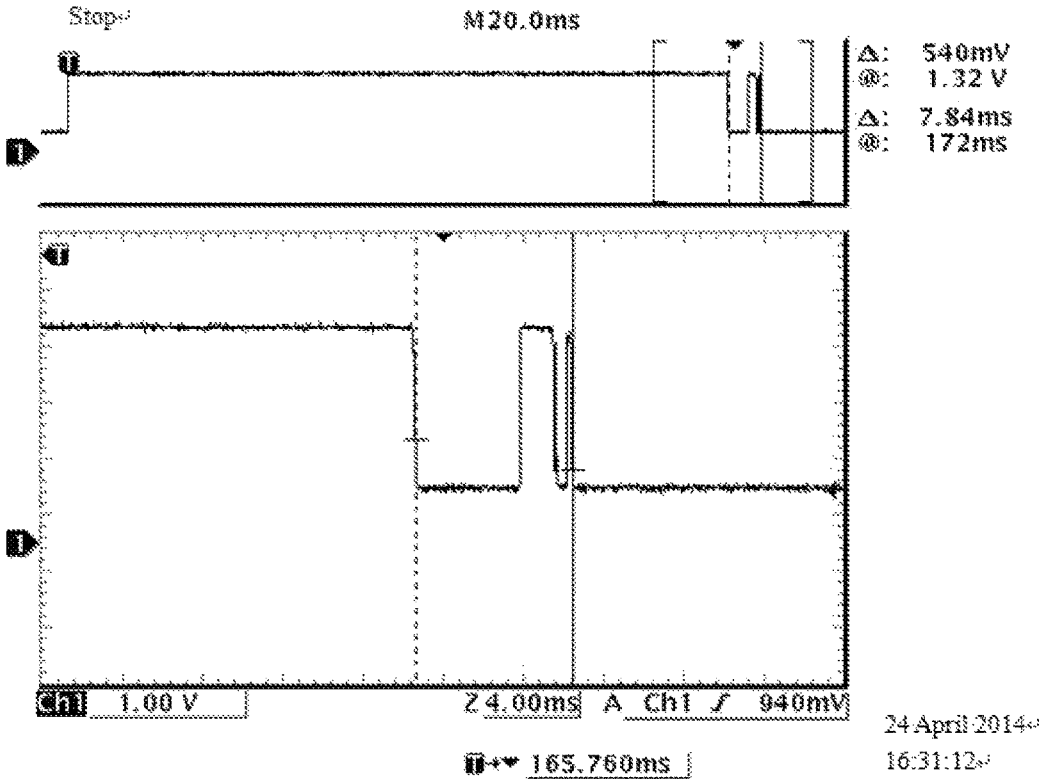
FIG. 3 is a test pattern of bouncing on an ordinary nickel-plated keypad according to the present invention.
Figure 4:
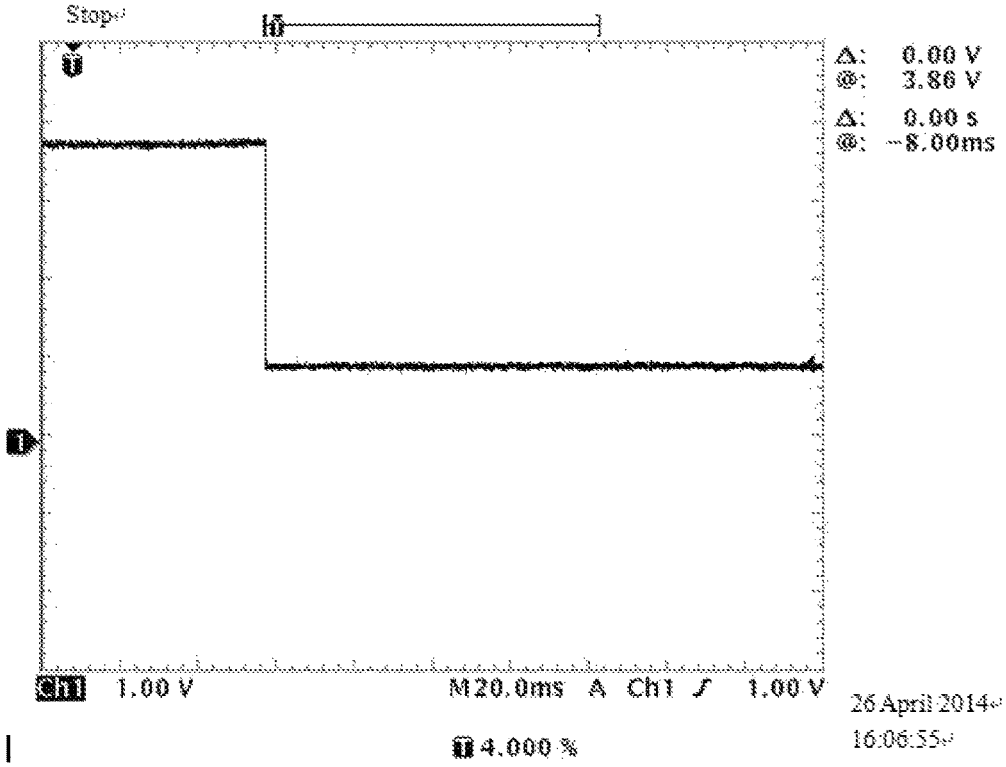
FIG. 4 is a test pattern of bouncing on a tin-plated keypad according to the present invention.

FIGS. 1 to 2 are structural schematic diagrams of the present invention, illustrating a rubber layer 1, a sheet metal layer 2, a tin alloy or lead alloy coated layer 3, a rubber substrate 4, a convex point or line or concave point or line 10, as well as a gold-plated contact 5 on a printed circuit board and the printed circuit board 6. As shown in FIGS. 3 to 4, a bouncing trace appears on a test pattern of bouncing on an ordinary nickel-plated keypad, while no keypad bouncing appears on a tin-plated keypad of the present invention.

The sheet metal layer was prepared by stainless steel (model number is 304; and national grade No. is 0Cr18Ni9) having a thickness of 0.1 mm. The stainless steel was rolled into a sheet having fine ripples by a mechanical method, wherein a peak height of the ripples was 0.1 mm and a peak spacing was 0.2 mm. Then a basic cleaning liquid having a pH value around 9 was used to clean and deoil the sheet, then the sheet was washed by water, and further cleaned and deoiled by industrial alcohol, and blow-dried by cold air. Other methods can also be used for cleaning, deoiling and activating.

Polymethylvinylphenylsiloxane gum (for example, Elastosil® R 401/60 produced by Wacker Chemie AG), vinyl tris-tert-butyl peroxy silane (VTPS) and dicumyl peroxide (DCP) were uniformly mixed by an open mill. The content of the VTPS in a rubber compound was 1%, and the content of the DCP in the rubber compound was 0.5%. VTPS was a coupling agent containing a peroxide component, which not only can crosslink silicone rubber containing vinyl but also can promote the bonding between the silicone rubber containing vinyl with metals (such as nickel, carbon steel, stainless steel, copper, or the like).

Heat vulcanization adhesion and heat vulcanization shaping were performed between the stainless steel sheet having fine rippers and the foregoing rubber compound under 165° C., wherein a curing time was 12 min, to form a layered composite sheet of stainless steel and silicone rubber having a thickness of 1.0 mm. A surface of a mold cavity of a mold for preparing the composite sheet had a Teflo coating. The existence of the Teflo coating prevented the rubber compound from being adhered to the mold during heat vulcanization. The composite sheet was punched into a small wafer having a diameter of 5 mm. The small wafer was cleaned by basic cleaning liquid, washed by water, then put into 10% dilute sulfuric acid for activation for 1 min, and then cleaned, and drained off.

Preparing a chemical plating bath having following compositions:

8 g/L stannous chloride dihydrate, 75 g/L trisodium citrate dihydrate, 20 g/L disodium edetate dihydrate, 10 g/L sodium acetate, 0.5 g/L benzene sulfonic acid, 0.2 g/L sodium saccharin, 8 g/L titanium trichloride, and proper aqueous ammonia were added to make the pH within 8.0-9.0. The chemical plating bath was in a ready-to-use form. Titanium trichloride may be resolved by deionized water or diluted hydrochloric acid, and not added into the plating bath earlier.

500 small wavers above were put into 300 mL plating bath above under a temperature of 80° C. and stirred continuously, taken out after 60 min, rinsed by distilled water or deionized water, drained off, and blow-dried by cold air, or put into a 70° C. constant temperature drying oven to dry, thus obtaining small wafers with a metal surface plated with a tin layer.

The small wafer containing the tin layer of the silicone rubber layer was used as a contact to perform heat vulcanization adhesion and heat vulcanization shaping with the silicone rubber, to form a rubber keypad containing the contact, as shown in FIG. 1. Heat vulcanization adhesion was performed between a silicone rubber face in the small wafer and other silicone rubber, wherein one face with a metal plated layer faced outwards, so that the metal plated layer may be contacted with other contact such as a gold-plated contact on a printed circuit board (PCB) to form an access, as shown in FIG. 2. When the contact in this keypad is contacted with other contact (such as the gold-plated contact on the PCB), a contact bouncing phenomenon will not occur substantially, or a bouncing time thereof is approaching to zero. Therefore, the keypad is a de-bouncing keypad. Our test showed that the switching times were more than 100,000 times when a current between the contacts was 50 mA, the resistance between the contacts was not increased substantially, and the switching-on performance of the contact was excellent. When the current between the contacts was 300 mA and the switching times were 30,000 times, the contact resistance between the contacts was not increased substantially and maintained within 1 ohm. Relatively, a contact bouncing phenomenon would occur when the keypad containing a stainless steel contact not plated with a tin layer was contacted with the gold-plated contact on the PCB, wherein the average bouncing time was about 10 ms; when the current between the contacts was 300 mA and the switching times were about 3000 times, the resistance between the contacts was increased remarkably, and raised to 10 ohm above.

Embodiment 2

The sheet metal used was the same as that in embodiment 1, but the sheet metal was processed by chemical plating to plate a layer of nickel having a thickness of 2.5 μm on a stainless steel sheet having fine ripples. One object of nickel plating was to reduce the resistance on the surface of the sheet metal (because the electric conductivity of the nickel was greater than that of the stainless steel), and the other object was to adhere the stainless steel and a tin alloy plated layer more firmly. Then the sheet metal treated in this manner was composited with silicone rubber, then punched into small wafers, plated with a tin alloy by chemical plating, and finally prepared into a de-bouncing and arc-ablation resistant keypad.

Embodiment 3

Like embodiment 1, the small wafer containing silicone rubber and stainless steel layer was prepared, then a layer of nickel having a thickness of 2.5 μm was plated on the small wafer, and then a tin alloy layer having a thickness of 2.5-5.0 μm was plated on a metal surface of the small waver as shown in embodiment 1, and this plated object was used as metal contact, and then a de-bouncing arc-ablation resistant keypad was prepared.

Embodiment 4

All the processes were similar to the embodiments 1, 2 or 3, but the compositions of the chemical plating bath used were different. The compositions of the plating bath adopted in the embodiment were as follows: 15 g/L stannous chloride dihydrate, 0.3 g/L lead chloride, 75 g/L trisodium citrate dihydrate, 25/L disodium edetate dihydrate, 15 g/L nitrilotriacetic acid, 2 g/L sodium saccharin, 8 g/L titanium trichloride, and proper aqueous ammonia or 10% acetic acid are added to make the pH within 6.0-7.5. The temperature of the chemical plating was set as 60° C., and the time was set as 1 h.

The plated layer obtained using the plating bath above was a tin lead alloy plated layer. The plated layer was more stable during storage and use, and tin "whisker" will not grow. The keypad having such a plated layer had no contact bouncing.

Embodiment 5

Like embodiment 1, a s stainless steel sheet having fine rippers and silicone rubber were prepared into a layered composite sheet of stainless steel and silicone rubber having a thickness of 1.0 mm. 10% dilute sulfuric acid solution was used to clean the composite sheet for 3 min. Then a tin alloy plated layer having a thickness of 2.5-5.0 μm was electroplated on the sheet. The plating bath and conditions used were as follows:

50 g/L stannous mono-sulphate, 90 g/L sulfuric acid and 0.4 g/L benzalacetone. The temperature of the plating bath was controlled to be 15° C. around, and the density of a cathode current was 1.0 A/dm$^2$.

In the plating bath, benzalacetone was a brightener. The sulfuric acid has such effects of reducing the activity of stannous ions, preventing the stannous ions from hydrolysis, improving the electrical conductivity of the plating bath and the efficiency of an anode current, etc. when the sulfuric acid was insufficient, the stannous ions were easily oxidized into quadrivalent tin.

Then the sheet plated with tin alloy was punched into small wavers having a diameter of 5 mm. The small wafer was used as a metal contact to perform heat vulcanization adhesion and heat vulcanization shaping with silicone rubber, to form a rubber keypad having a contact. The keypad prepared also had excellent de-bouncing effect and arc-ablation resistance.

Embodiment 6

A 400-mesh stainless steel plain net (the model of the stainless steel was 304) was used to replace the stainless steel sheet having fine ripples in embodiment 1, and the contact prepared using the process in embodiment 1 also had preferable de-bouncing effect and preferable arc-ablation resistance.

A mesh of the 400-mesh stainless steel net was very small, and the silicone rubber will not penetrate through the mesh of the stainless steel net when molding the stainless steel net with the silicone rubber. If a stainless steel net with a small mesh number, for instance, a stainless steel net with a mesh below 80, was selected, a technical problem that the silicone rubber penetrated through the mesh of the stainless steel net during molding will occur. Therefore, a stainless steel net with a larger mesh number needs to be adopted for preparing a switch contact having a plated layer.

Embodiment 7

A rubber keypad containing a contact plated with a tin layer was prepared like embodiments 1, 2, 3, 5 or 6. The rubber keypad was processed using a basic lead solution to replace partial tin in the tin coated layer on the surface of the contact with lead, thus forming a paper-thin tin lead alloy on the surface of the plated layer of the contact. In this way, "whisker" will not grow in the plated layer of the contact in the rubber keypad while the rubber keypad has de-bouncing function and arc-ablation resistance.

What is claimed is:

1. A de-bouncing keypad, comprising:

a rubber substrate; and a metal contact, which is a layered complex including a first layer, a second layer, and a third layer, attached with the rubber substrate, wherein the first layer is a rubber layer having a thickness of 0.1-10 mm and contacts the rubber substrate, wherein the second layer is a sheet metal layer having a thickness of 0.1-10 mm and containing magnesium, aluminum, titanium, chromium, manganese, ferrum, cobalt, nickel, copper, zinc, niobium, molybdenum, silver, tin, tantalum or tungsten, and wherein the third layer is a tin alloy plated layer or lead alloy plated layer having a thickness of 0.1-10 μm selectively deposited onto the second layer.

2. The de-bouncing keypad according to claim 1, wherein the third layer is electroplated onto the second layer.

3. The de-bouncing keypad according to claim 1, wherein the third layer is chemically deposited onto the second layer.

4. The de-bouncing keypad according to claim 1, wherein the third layer is plated onto one or two sides of the second layer.

5. The de-bouncing keypad according to claim 1, wherein the rubber substrate is a natural rubber, styrene butadiene rubber, butadiene rubber, ethylene propylene rubber, ethylene propylene diene monomer, urethane rubber, methylvinylsiloxane gum or polymethylvinylphenylsiloxane gum.

6. The de-bouncing keypad according to claim 1, wherein the rubber substrate is an ethylene propylene diene monomer, methyl vinyl silicone rubber or polymethylvinylphenylsiloxane gum.

7. The de-bouncing keypad according to claim 1, wherein the first layer is a hydrophobic rubber enabling a water contact angle on a rubber surface to be greater than 65 degrees.

8. The de-bouncing keypad according to claim 7, wherein the hydrophobic rubber is a nonpolar or weak polar rubber.

9. The de-bouncing keypad according to claim 8, wherein the hydrophobic rubber is an ethylene propylene diene monomer, methylvinylsiloxane gum or polymethylvinylphenylsiloxane gum.

10. The de-bouncing keypad according to claim 1, wherein the second layer is a metal sheet having a convex point or a concave point, a metal sheet having a convex line or a concave line, a metal sheet having a convex surface or a concave surface, a metal sheet having a small hole with an area less than 1 mm$^2$, a metal gauze, metal foams or a metal fiber sintered felt.

11. The de-bouncing keypad according to claim 10, wherein the metal sheet of the second layer is composed of a stainless steel sheet.

12. A de-bouncing keypad, comprising:

a rubber substrate; and a metal contact, which is a layered complex including a first layer, a second layer, and a third layer, attached with the rubber substrate, wherein the first layer is a rubber layer having a thickness of 0.1-10 mm;

wherein the second layer is a sheet metal layer having a thickness of 0.1-10 mm and containing magnesium, aluminum, titanium, chromium, manganese, ferrum, cobalt, nickel, copper, zinc, niobium, molybdenum, silver, tin, tantalum or tungsten, wherein the second layer is a metal sheet having a convex point or a concave point, a metal sheet having a convex line or a concave line, a metal sheet having a convex surface or a concave surface, a metal sheet having a small hole with an area less than 1 $mm^2$, a metal gauze, metal foams or a metal fiber sintered felt; and wherein the third layer is a tin alloy plated layer or lead alloy plated layer having a thickness of 0.1-10 μm selectively deposited onto the second layer.

13. The de-bouncing keypad according to claim 12, wherein the metal sheet of the second layer is composed of a stainless steel sheet.

14. The de-bouncing keypad according to claim 12, wherein the third layer is electroplated onto the second layer.

15. The de-bouncing keypad according to claim 12, wherein the third layer is chemically deposited onto the second layer.

16. The de-bouncing keypad according to claim 12, wherein the third layer is plated onto one or two sides of the second layer.

17. The de-bouncing keypad according to claim 12, wherein the rubber substrate is a natural rubber, styrene butadiene rubber, butadiene rubber, ethylene propylene rubber, ethylene propylene diene monomer, urethane rubber, methylvinylsiloxane gum or polymethylvinylphenylsiloxane gum.

18. The de-bouncing keypad according to claim 12, wherein the rubber substrate is an ethylene propylene diene monomer, methyl vinyl silicone rubber or polymethylvinylphenylsiloxane gum.

19. The de-bouncing keypad according to claim 12, wherein the first layer is a hydrophobic rubber enabling a water contact angle on a rubber surface to be greater than 65 degrees.

20. The de-bouncing keypad according to claim 19, wherein the hydrophobic rubber is a nonpolar or weak polar rubber.

21. The de-bouncing keypad according to claim 20, wherein the hydrophobic rubber is an ethylene propylene diene monomer, methylvinylsiloxane gum or polymethylvinylphenylsiloxane gum.

* * * * *